US006112496A

United States Patent [19]

Hugus et al.

[11] Patent Number: 6,112,496

[45] Date of Patent: Sep. 5, 2000

[54] METAL AND WOOD DOOR WITH COMPOSITE PERIMETER

[75] Inventors: William S. Hugus, Latrobe, Pa.; Daniel L. Hibbs, Colby, Wis.

[73] Assignee: Weyerhaeuser and Overly Manufacturing Company

[21] Appl. No.: 09/161,036

[22] Filed: Sep. 25, 1998

[51] Int. Cl.[7] ..... G04C 1/00

[52] U.S. Cl. ..... 52/784.11; 52/309.11; 52/801.11; 52/801.17; 49/501

[58] Field of Search ..... 49/501; 52/783.1, 52/789.1, 784.11, 784.12, 784.13, 792.1, 797.1, 800.1, 801.1, 801.11, 801.12, 800.13, 800.17, 309.7, 309.9, 309.11

[56] References Cited

U.S. PATENT DOCUMENTS

| | | | |
|---|---|---|---|
| 1,810,321 | 6/1931 | Michelman . | |
| 1,928,034 | 9/1933 | Schulstadt . | |
| 2,297,609 | 9/1942 | Clark et al. . | |
| 2,787,345 | 4/1957 | Soubier et al. . | |
| 3,153,817 | 10/1964 | Pease, Jr. . | |
| 3,273,297 | 9/1966 | Wehe . | |
| 3,295,273 | 1/1967 | Wehe . | |
| 3,319,738 | 5/1967 | Wehe . | |
| 3,336,713 | 8/1967 | Privas . | |
| 3,583,118 | 6/1971 | Lowery . | |
| 3,785,103 | 1/1974 | Turner . | |
| 3,786,609 | 1/1974 | Difazio . | |
| 3,786,613 | 1/1974 | Shepheard . | |
| 3,834,101 | 9/1974 | Wilder . | |
| 3,934,382 | 1/1976 | Gartung . | |
| 4,140,824 | 2/1979 | Gaillard . | |
| 4,155,211 | 5/1979 | Saylor . | |
| 4,194,329 | 3/1980 | Wendt . | |
| 4,203,255 | 5/1980 | Naslund . | |
| 4,265,067 | 5/1981 | Palmer . | |
| 4,282,687 | 8/1981 | Teleskivi | 52/784.11 X |
| 4,318,453 | 3/1982 | Rose . | |
| 4,374,693 | 2/1983 | Pitt . | |
| 4,446,663 | 5/1984 | Stumpf . | |
| 4,589,240 | 5/1986 | Kendall . | |
| 4,602,466 | 7/1986 | Larson . | |
| 4,657,798 | 4/1987 | Guilhem . | |
| 4,746,555 | 5/1988 | Luckanuck . | |
| 4,765,105 | 8/1988 | Tissington . | |
| 4,774,119 | 9/1988 | Imhoff . | |
| 4,807,411 | 2/1989 | Capaul . | |
| 4,860,512 | 8/1989 | Thorn . | |
| 4,922,674 | 5/1990 | Thorn . | |
| 4,998,598 | 3/1991 | Mardian . | |
| 5,020,292 | 6/1991 | Strom . | |
| 5,074,087 | 12/1991 | Green . | |
| 5,077,948 | 1/1992 | Olson . | |
| 5,142,835 | 9/1992 | Mrocca . | |
| 5,218,807 | 6/1993 | Fulford . | |
| 5,239,799 | 8/1993 | Bies et al. | 52/784.13 X |
| 5,361,552 | 11/1994 | Fulford . | |
| 5,391,245 | 2/1995 | Turner . | |
| 5,416,285 | 5/1995 | Niehaus . | |
| 5,417,029 | 5/1995 | Hugus . | |
| 5,422,170 | 6/1995 | Iwata . | |

FOREIGN PATENT DOCUMENTS

| | | |
|---|---|---|
| 851003 | 9/1970 | Canada . |
| 858917 | 12/1970 | Canada . |
| 79 03466 | 10/1980 | France . |

*Primary Examiner*—Richard Chilcot
*Attorney, Agent, or Firm*—Cohen & Grigsby, P.C.

[57] ABSTRACT

In a composite metal and wood door, two metal panels (10,32) that are aligned in parallel relationship are secured together by connectors (56–70, 88–102). Panels (10,32) and connectors (56–70, 88–100) cooperate to define channels (122–136) that receive corresponding members (138–148) that are made of a composite material. Metal panels (10,32) and composite members (138–148) are covered by wooden panels (178, 180).

16 Claims, 5 Drawing Sheets

METAL AND WOOD DOOR WITH COMPOSITE PERIMETER

BACKGROUND OF THE INVENTION

1. Field of the Invention

The subject invention relates to composite metal and wood doors and, more particularly, composite doors that have a high fire rating as well as a high degree of sound attenuation.

2. Description of the Prior Art

Many types of wood doors have been developed with improved insulation properties. Frequently, such doors have a wooden subframe with an insulative foam core. Examples are found in U.S. Pat. Nos. 5,361,522 and 5,218,807. Although these doors had improved thermal insulative properties, they were not fire retardant and could not be used in applications where high fire ratings were required.

Doors having fire retardant qualities also have been developed. Such fire-retardant doors have various designs. Examples that employ a fire-retardant core or that incorporate fire-retardant chemicals are shown in U.S. Pat. Nos. 4,203,255 and 4,746,555. Still other doors have been designed with the objective of increasing sound attenuating properties. Such doors have a variety of structures and designs, some examples of which are shown in U.S. Pat. Nos. 4,998,598 and 5,416,285. However, it has been generally found that doors that have been designed singularly with regard to fire-retardant properties or with regard to sound attenuating properties, generally do not afford high performance in both respects.

In some instances, it has been desirable to have a door with combined properties of a given fire rating and a given sound attenuation. Examples that are directed to both of these objectives are shown in U.S. Pat. Nos. 5,422,170 and 5,417,029. With particular regard to fire-retardant, sound attenuating doors, it has been desirable to improve the appearance of these doors by adding a wood or other decorative laminate. However, it has been found that the addition of such a laminate to doors of such prior art designs has frequently tended to compromise the fire retarding or sound attenuating properties of the doors.

Accordingly, there was a need in the prior art for a door with improved aesthetics, but that also had high tolerance to fire and was effective in attenuating noise.

SUMMARY OF THE INVENTION

In accordance with the subject invention, a door is formed from two metal panels that are spaced apart in parallel relationship. Connectors are attached to the opposing surfaces of each of the panels such that they cooperate with the perimeter edges of the panels to define recessed portions of the surface of each panel. The respective connectors are also attached to each other and cooperate with the recessed portions of both panels to form channels around the perimeter of the panels. Composite members are received in the perimeter channels.

Preferably, the composite members have a first portion that is received in the perimeter channel and a second portion that extends outwardly from the edges of the two panels.

Also preferably, the outwardly extending portions of the composite members define substantially planar surfaces that are flush with the outer surface of each of the panels such that the composite members and the panels cooperate to provide a substantially flat support surface.

More preferably, the door is further provided with a decorator panel such as a wood panel that is secured to the metal panel and to the composite members.

Most preferably, the composite members are a molded mixture that includes gypsum cement and diatomaceous earth.

Other objects and advantages of the subject invention will become apparent to those skilled in the art as a description of a presently preferred embodiment thereof proceeds.

BRIEF DESCRIPTION OF THE DRAWINGS

The accompanying drawings illustrate a presently preferred embodiment of the invention in which.

PREFERRED EMBODIMENT OF THE INVENTION

A presently preferred embodiment of the subject invention is disclosed in FIGS. 1–7 herein. As particularly shown in FIGS. 2–4, a metal panel 10 has an exterior planar surface 12 and an interior planar surface 14. Interior planar surface 14 is oppositely disposed on panel 10 from exterior planar surface 12. The perimeter boundaries of exterior surface 12 and interior surface 14 are defined by edges 16, 18, 20, 22, 24, 26, 28 and 30 which extend between exterior surface 12 and interior surface 14.

Figure 1:
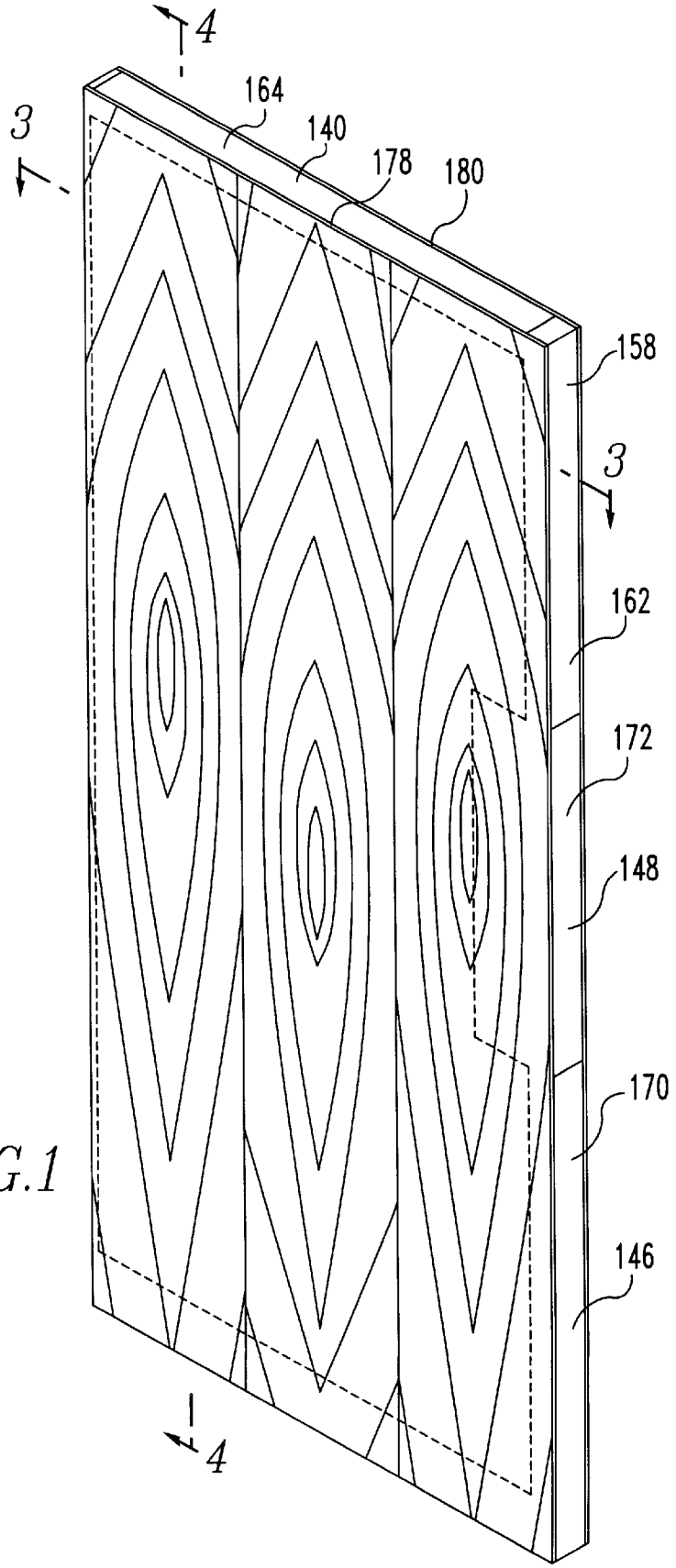
FIG. 1 is a perspective view of a door construction in accordance with the present invention.
Figure 2:
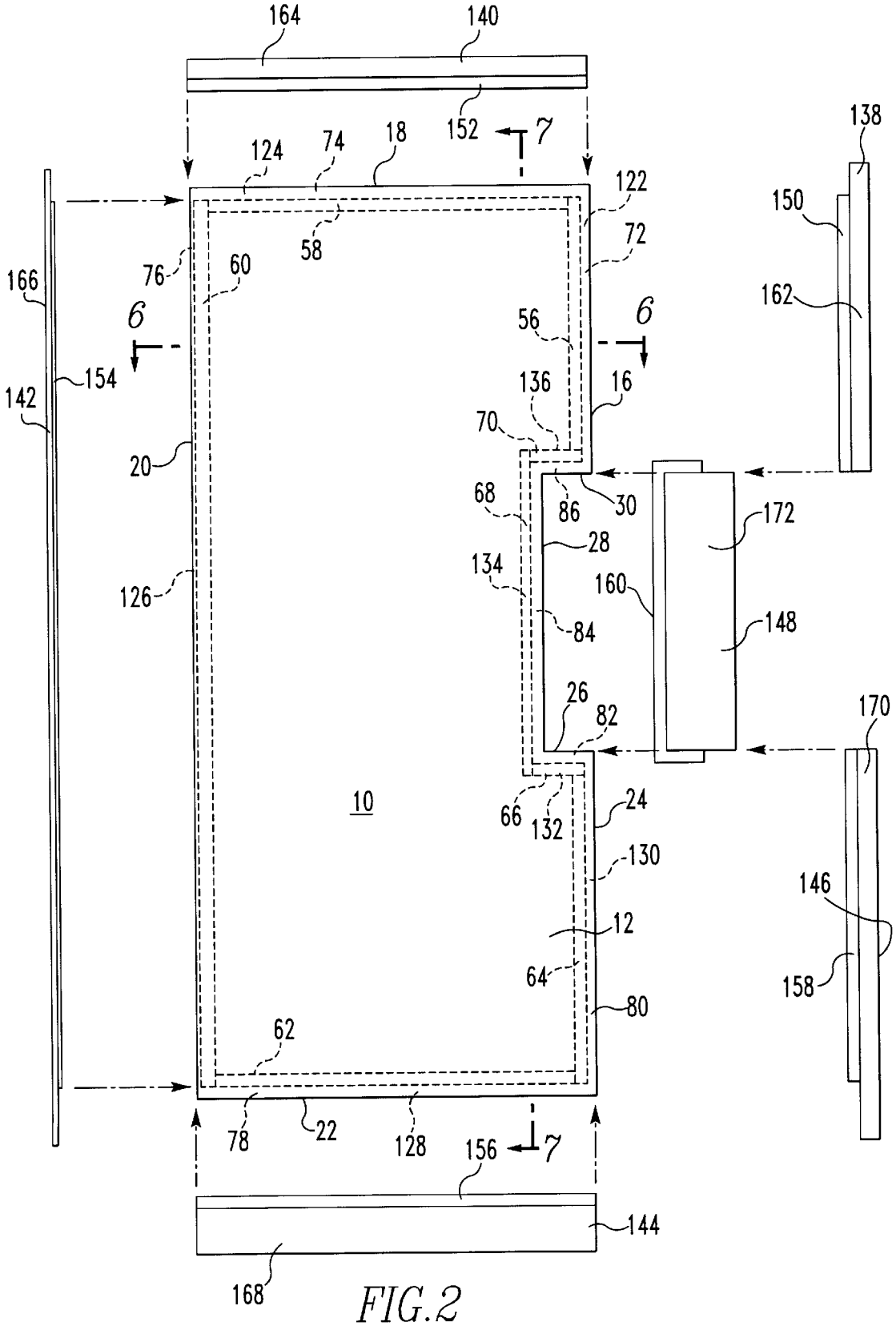
FIG. 2 is an elevation view of the door shown in FIG. 1 wherein the composite members are exploded from the rest of the door structure.
Figure 3:
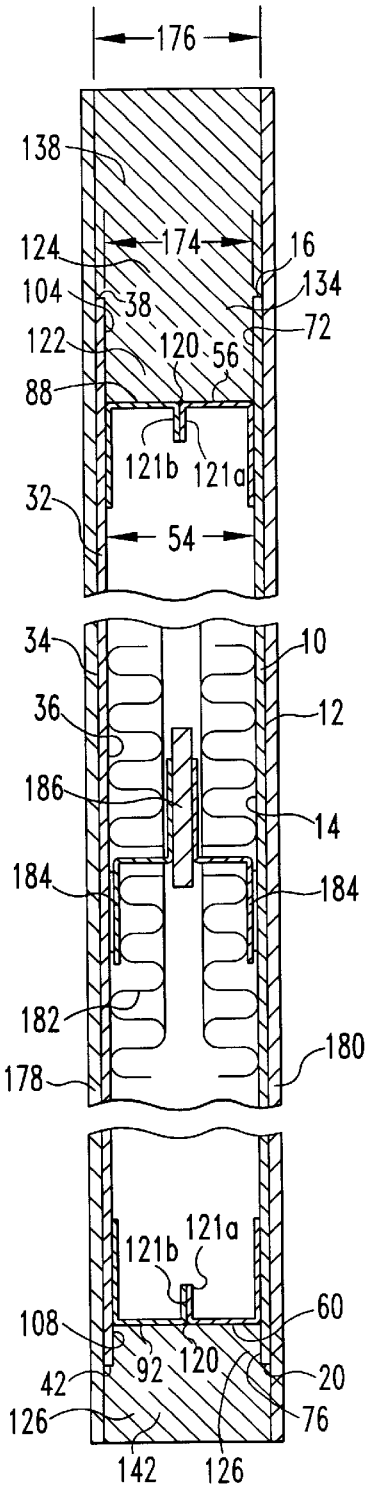
FIG. 3 is a horizontal cross-sectional view of the door shown in FIG. 1 taken along the lines 3—3 of FIG. 1.
Figure 4:
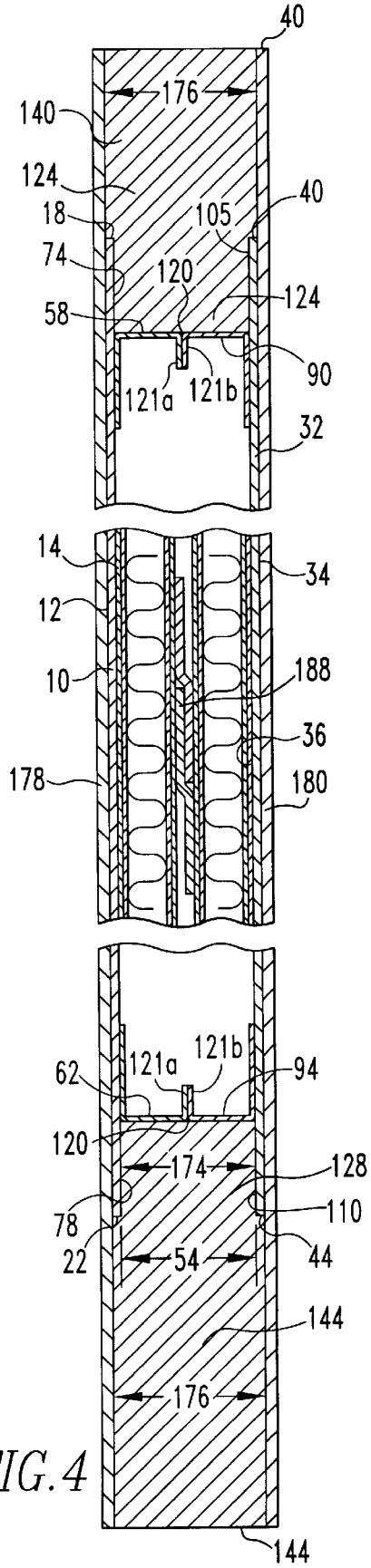
FIG. 4 is a vertical cross sectional view of the door shown in FIG. 1 taken along the 4—4 of FIG. 1.
Figure 5:
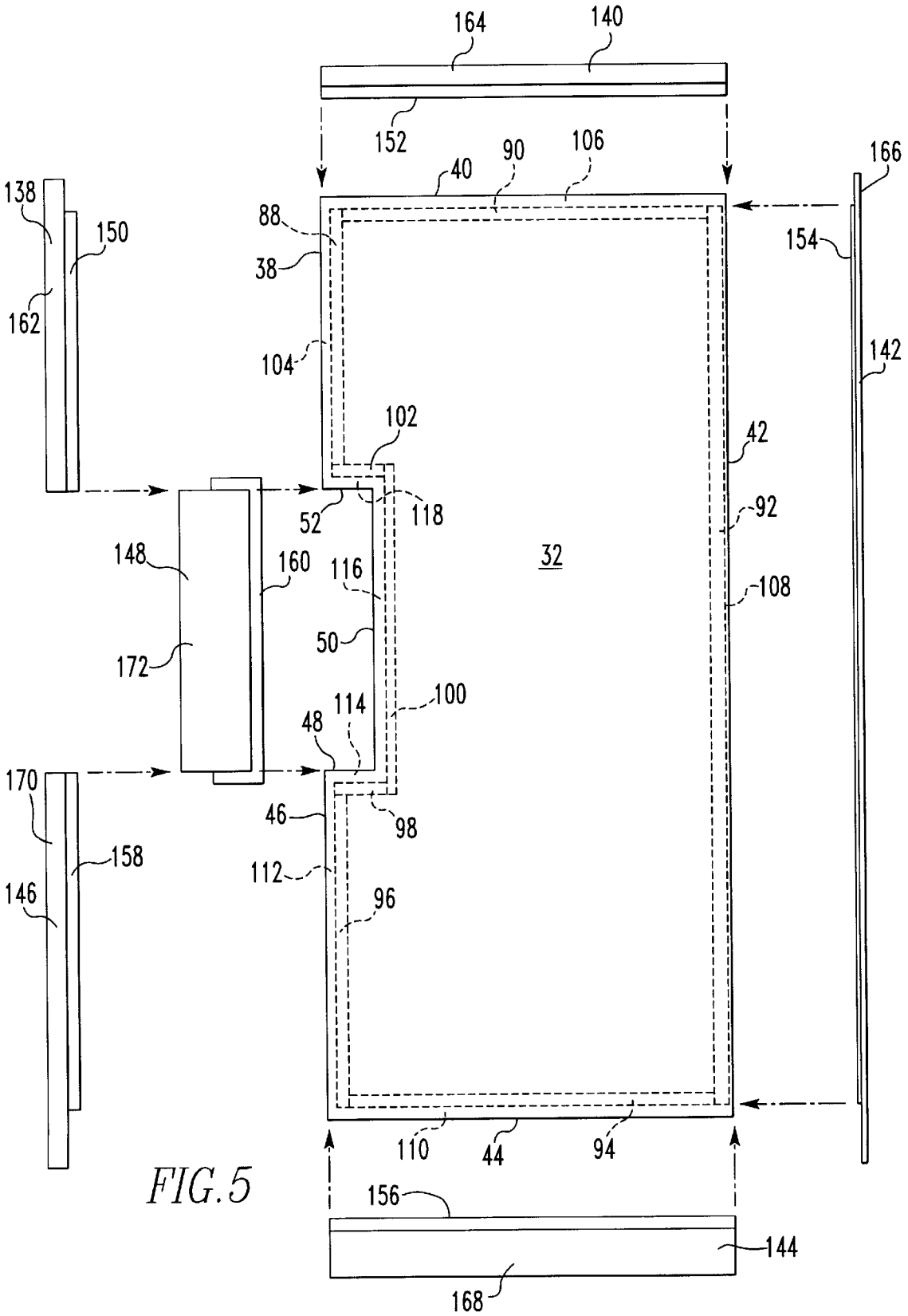
FIG. 5 is an elevation view of the door shown in FIGS. 1–4 taken from the opposite side of the door shown in FIG. 2 and wherein the composite members are exploded from the rest of the door structure.

As particularly shown in FIGS. 3–5, a second metal panel 32 has an exterior planar surface 34 and an interior planar surface 36. Interior planar surface 36 is oppositely disposed on panel 32 from exterior planar surface 34. The perimeter boundaries of exterior surface 34 and interior surface 36 are defined by edges 38, 40, 42, 44, 46, 48, 50 and 52. Metal panel 32 is generally oriented parallel to metal panel 10 and is spaced apart from panel 10. Interior surface 14 is in generally opposing relationship to interior surface 36 to define a gap 54 therebetween.

As best shown in FIGS. 2–7, a plurality of first connectors 56, 58, 60, 62, 64, 66, 68, and 70 are attached to interior surface 14 of metal panel 10. Each of connectors 56–70 corresponds to a respective edge 16–30 of panel 10 and each of connectors 56–70 is attached to interior surface 14 of panel 10 at a location that is recessed from the respective edge 16–30 such that connectors 56–70 cooperate with respective edges 16–13 to define therebetween recessed areas 72, 74, 76, 78, 80, 82, 84 and 86 on interior surface 14.

As best shown in FIGS. 3–7, second connectors 88, 90, 92, 94, 96, 98, 100, and 102 are attached to interior surface 36 of metal panel 32. Each of connectors 88–102 corresponds to a respective edge 38–52 of panel 32 and each of connectors 88–102 is attached to interior surface 36 of panel 32 at a location that is recessed from the respective edge 38–52 such that connectors 88–102 cooperate with respective edges 38–52 to define therebetween recessed areas 104, 106, 108, 110, 112, 114, 116 and 118 on interior surface 36.

First connectors 56–70 are respectively attached to second connectors 88–102 at selected points by means of spot welds 120 or other equivalent means. Preferably, first connectors 56–70 and second connectors 88–102 have a cross-sectional shape in the general form of a "J" or other substantially equivalent cross-section such that connectors 56–70 incorporate a lip 121*a* and connectors 88–102 incorporate a lip 121*b*. It has been found that such shapes provide additional material for dissipating heat at the point of spot weld 120 thus resulting in a stronger attachment between first connectors 56–70 and second connectors 88–102.

Figure 6:
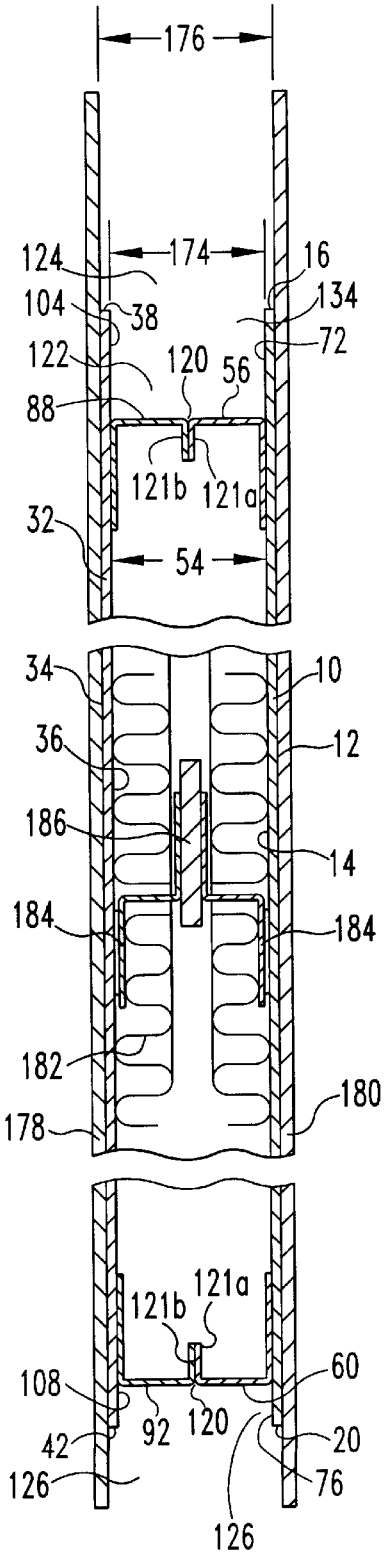
FIG. 6 is a partial horizontal cross-sectional view of the door shown in FIG. 2 taken along the lines 6—6 of FIG. 2.
Figure 7:
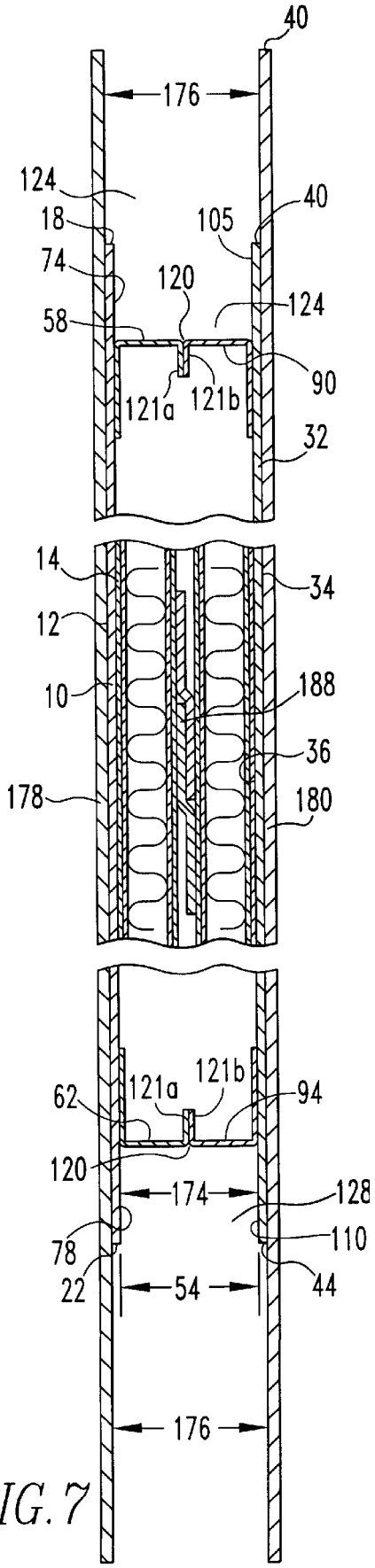
FIG. 7 is a partial vertical cross-sectional view of the door shown in FIG. 2 taken along the lines 7—7 of FIG. 2.

As particularly shown in FIGS. 6 and 7, each of said first connectors 56–70 cooperates with respective second connectors 88–102 to form connector pairs 56 and 88; 58 and 90; 60 and 92, 62 and 94, 64 and 96, 66 and 98, 68 and 100, and 70 and 102. Additionally, each connector pair cooperates with respective recessed areas 72–86 and 104–118 to define respective channels 122, 124, 126, 128, 130, 132, 134 and 136.

Referring to FIGS. 2–5, disclosed door further includes composite members 138, 140, 142, 144, 146 and 148 that correspond to respective channels 122–136. Each of composite members 138–148 includes a separate flange section 150, 152, 154, 156, 158 and 160 and a respective extension portion 162, 164, 166, 168, 170 and 172. Flange sections 150–160 matingly engage channels 122–136 and extension portions 162–172 extend beyond edges 16–30 and 38–52 of panels 10 and 32. In this way, composite members 138–148 cooperate to extend beyond the edges of panels 10 and 32 and define the outer edges of the door. Preferably flange sections 150–160 have cross-sectional thickness 174 that is substantially equal to the dimension of gap 54 between interior surfaces 14 and 36. Also preferably, extension portions 162–172 of composite members 138–148 have a cross-sectional thickness 176 that is substantially equal to the normal dimension between exterior surfaces 12 and 34. In this way extension portions 162–172 cooperate with metal panels 10 and 32 to provide a substantially continuous planar surface.

Preferably, composite members 138–148 are made from a compound of inert materials such as gypsum cement and diatomaceous earth. Composite members 138–148 may be constructed by pouring an aqueous slurry of gypsum cement and diatomaceous earth into molds with cavities that correspond to the respective shapes of composite members 138–148 as disclosed herein. Further details concerning the preparation of such a mixture are disclosed in U.S. Pat. No. 5,391,245 which is hereby specifically incorporated by reference.

The disclosed door further includes wooden panels 178 and 180 or equivalent decorative panels. Panels 178 and 180 are respectively secured to the exterior surfaces 12 and 34 of metal panels 10 and 32 and are also secured to the surfaces of composite members 138–148 to provide a preferred appearance for the assembled door.

As also shown in FIGS. 3 and 4, mineral wool 182 can be incorporated in gap 54. Vertical stiffeners 184 can also be secured to the anterior surfaces 14 and 36 of panels 10 and 32 by double sided adhesive or equivalent means. Vertical stiffeners 184 are arranged in opposing pairs that are connected to oppositely disposed sides of an array of vinyl spacers 186. In addition, the disclosed door assembly can include horizontal interlocking support members 188 such as are shown in FIG. 4.

While a presently preferred embodiment of the invention disclosed herein has been shown and described, the invention is not limited thereto, but may be otherwise embodied within the scope of the following claims.

We claim:

1. A door comprising:

a first metal panel having an exterior planar surface and an interior planar surface that is oppositely disposed from said exterior surface, said exterior and interior surfaces being bounded by perimeter edges that extend between the exterior and interior surfaces;

a second metal panel having an exterior planar surface and an interior planar surface that is oppositely disposed from said exterior surface, said exterior and interior surfaces being bounded by perimeter edges that extend between the exterior and interior surfaces; said second metal panel being spaced apart from said first panel and oriented substantially parallel to said first panel with the interior surface of said second panel located in opposing relationship to the interior surface of said first metal panel a first connector that is connected to the interior surface of said first metal panel at a location on said first metal panel that is set back from the perimeter edge of said first metal panel, said first connector and said perimeter edge defining therebetween a recessed portion of the interior surface of said first metal panel, said first connector having a distal portion that extends away from the first metal panel;

a second connector that is connected to the interior surface of said second metal panel at a location on said second metal panel that is set back from one perimeter edge of said second metal panel, said second connector and said perimeter edge defining therebetween a recessed portion of the interior surface of said second metal panel, said second connector having a distal portion that extends away from the second metal panel, said second connector also being connected to said first connector, said first and second connectors cooperating with the recessed portions of the interior surfaces of said first and second panels to define a channel; and at least one composite member, said composite member having a first portion that is sized to engage the channel defined by the first and second connectors and by the recessed portions of the first and second panels.

2. A door assembly comprising:

a first metal panel having perimeter edges between an exterior surface and an interior surface that is oppositely disposed on said first panel from said exterior surface;

a second metal panel that has perimeter edges between an exterior surface and an interior surface that is oppositely disposed on said second panel from said exterior surface, said second metal panel being spaced apart from said first panel and with the interior surface of said second panel opposing the interior surface of said first panel;

a first J-member that is connected to the interior surface of said first metal panel at a location that is recessed from a perimeter edge of said first panel;

a second J-member that is connected to the interior surface of said second metal panel at a location that is recessed from a perimeter edge of said second panel, said second J-member being connected to said first J-member and said first and second J-members cooperating with the recessed portions of said first and second panels to define a channel; and at least one composite member, one portion of said composite member engaging the channel defined by said first and second J-members in cooperation with the extension portions of said first and second panels and another portion of said composite member laterally extending beyond the perimeter edge of said first panel and the perimeter edge of said second panel.

3. The door assembly of claim 2 wherein said composite member is comprised of a composite material of gypsum cement and diatomaceous earth.

4. The door assembly of claim 2 further comprising a first wooden panel that is secured to the external side of said first metal panel and a second wooden panel that is secured to the external side of said second metal panel.

5. The door assembly of claim 2 wherein said composite member comprises a bottom rail.

6. The door assembly of claim 2 wherein said composite member comprises a top rail.

7. The door assembly of claim 2 wherein said composite member comprises a lock stile.

8. The door assembly of claim 2 wherein said composite member comprises a hinge stile.

9. The door assembly of claim 2 wherein said composite member comprises a lock block.

10. The door assembly of claim 2 wherein the means for connecting the first and second J-members comprises an array of tack welds.

11. The door assembly of claim 2 wherein the first and second panels define a gap therebetween and wherein mineral wool is contained in said gap.

12. The door assembly of claim 2 and further comprising first and second vertical stiffeners connected to the first and second panels and wherein the vertical stiffeners are connected by adhesive tape.

13. The door assembly of claim 12 wherein said vertical stiffeners are connected to a vinyl spacer.

14. The door assembly of claim 13 further comprising interlocking lateral stiffeners.

15. The assembly of claim 14 wherein the interlocking lateral stiffener is comprised of two overlapping members.

16. A door assembly comprising:

a first metal panel having perimeter edges that define the boundary of an exterior surface and an interior surface where said exterior surface is oppositely disposed on said panel with respect to said interior surface a second metal panel having perimeter edges that define the boundary of an exterior surface and an interior surface, where said exterior surface is oppositely disposed on said panel with respect to said interior surface, said second metal panel being oriented in generally parallel relationship to the first metal panel with the interior surface of said first metal panel opposing the interior surface of said second metal panel and said first and second panels being spaced apart with the interior surfaces of said first and second panels defining a gap therebetween a plurality of first connecting members that are attached to the interior surface of said first metal panel, each of said first connecting members being attached at a respective location on said first metal panel that is recessed from and generally parallel to a corresponding perimeter edge of said first metal panel a plurality of second connecting members that are attached to the interior surface of said second metal panel, each of said second connecting members being attached at a respective location on said second metal panel that is recessed from and generally parallel to a corresponding perimeter edge of said second metal panel, each of said first connecting members also being attached to a respective one of said second connecting members, each of said attached pair of connecting members cooperating with the corresponding recessed areas of the interior surfaces of said first and second panels to define a channel;

a plurality of composite members, each of said composite members having a flanged portion that is received in a respective channel that is defined by the attached pair of connecting members in cooperation with the recessed areas of the first and second panels, said composite members extending beyond the perimeter edges of said first and second panels and having an edge that is oppositely disposed from said flange portion and that defines the outer edge of said door, each of said composite members having a first side between the perimeter edge of the first panel and the edge of the composite member, and also having a second side between the perimeter edge of the second panel and the edge of said composite member;

a first wooden panel that is secured to the external side of said first metal panel and to the first side of each of said composite members; and a second wooden panel that is secured to the external side of said second metal panel and to the second side of each of said composite members.

* * * * *